US010952536B1

(12) United States Patent
Williams et al.

(10) Patent No.: US 10,952,536 B1
(45) Date of Patent: Mar. 23, 2021

(54) CONNECTING TABLE SYSTEM

(71) Applicant: Poly-Wood, LLC, Syracuse, IN (US)

(72) Inventors: Brandon Williams, Bremen, IN (US); Benjamin Powers, Columbia City, IN (US); Keith Puckett, Middlebury, IN (US); Neil Joldersma, Elkhart, IN (US)

(73) Assignee: Poly-Wood, LLC, Syracuse, IN (US)

( * ) Notice: Subject to any disclaimer, the term of this patent is extended or adjusted under 35 U.S.C. 154(b) by 0 days.

(21) Appl. No.: 16/746,261

(22) Filed: Jan. 17, 2020

(51) Int. Cl.
*A47C 7/70* (2006.01)
*A47B 83/02* (2006.01)
*A47C 11/00* (2006.01)

(52) U.S. Cl.
CPC ..... *A47C 7/705* (2018.08); *A47B 83/02* (2013.01); *A47C 11/005* (2013.01)

(58) Field of Classification Search
CPC ..... A47C 7/068; A47C 7/705; A47C 11/005; A47B 83/02
USPC .... 297/135, 136, 145, 148, 153, 157.1, 160, 297/170, 244, 245, 248, 452.62; 108/42, 108/50.11, 64, 65, 157.13
See application file for complete search history.

(56) References Cited

U.S. PATENT DOCUMENTS 506,085 A * 10/1893 Whelan ..... A47C 7/705 297/160
797,826 A * 8/1905 Sherman ..... A47B 83/045 312/235.2
929,302 A * 7/1909 Hanlon ..... A47B 83/02 297/170
3,017,219 A * 1/1962 Mallett ..... A47C 7/68 297/135
3,093,411 A * 6/1963 Mallett ..... A47C 7/68 297/135
4,311,337 A * 1/1982 Brunn ..... A47B 83/02 297/342
D265,952 S * 8/1982 Theodore ..... D6/336
4,657,302 A * 4/1987 Snyder ..... A47C 1/124 108/64
4,968,092 A * 11/1990 Giambrone ..... A47D 1/0081 297/151
D430,743 S * 9/2000 Pomeroy ..... D6/336
D450,937 S * 11/2001 Pomeroy ..... D6/344
D464,492 S * 10/2002 Pomeroy ..... D6/336
D704,459 S * 5/2014 Zhang ..... D6/335

* cited by examiner

*Primary Examiner* — Robert Canfield
(74) *Attorney, Agent, or Firm* — Maginot, Moore & Beck, LLP

(57) ABSTRACT

A connecting table Tete-A-Tete system in one embodiment includes a connecting table with two arm receptacle portions each configured to removably receive an arm of a respective seat. The system includes a coupling bar movable between a first position whereat the arms can be inserted into or removed from the respective arm receptacle portions and a second position whereat the arms cannot be inserted into or removed from the respective arm receptacle portions.

18 Claims, 4 Drawing Sheets

CONNECTING TABLE SYSTEM

FIELD

The disclosure relates to Tete-A-Tete systems and more particularly to a connecting table Tete-A-Tete system.

BACKGROUND

In general, a Tete-A-Tete system is a configuration of two seating areas which are arranged so as to facilitate conversation between individuals positioned in the seating areas. Tete-A-Tete systems are alternatively referred to as courting chairs (sofas), vis-à-vis, and gossip couches.

Traditional Tete-A-Tete systems have been modified to incorporate a table between two chairs to provide a place for beverages, books, phones, etc. In some of these systems, the inner arms of the chairs are replaced with a table which permanently couples the chairs and table into a unit. In these systems, the chair portions are uniquely constructed for use in a Tete-A-Tete system.

In an effort to incorporate the use of chairs which are not necessarily uniquely constructed for use in a Tete-A-Tete system various connecting tables were developed. In one system, a bottom mount connecting table is used to permanently couple two individual chairs into a unit. The top surface of a bottom mount connecting table is typically flush with or slightly below the tops of the arms of the individual chairs when the chairs and connecting table are coupled. This approach typically incorporates special mounting hardware to provide a permanent coupling.

Non-permanent coupling approaches have also been developed. Such approaches include the incorporation of top mount connecting tables. In a top mount connecting table system, the connecting table is positioned on the upper surface of arms of the individual chairs. These systems are typically easy to use and do not include permanent coupling hardware. In fact, some systems incorporate a connecting table which simply rests on the upper surfaces of two of the arms of the individual chairs and is not mechanically coupled to the chairs. In this type of system however, the connecting table is easily dislodged such as by accidental bumping, movement caused by wind, etc., which can damage items such as phones which are on the connecting table as well as spilling drinks. Moreover, it is difficult to determine whether the connecting table is optimally positioned for stability without somehow visually accessing the underside of the table.

In other top mount systems various components are provided to more securely couple the connecting table to the individual chairs. In some systems pivoting arms are incorporated with the connecting table. The pivoting arms are positioned beneath two chair arms of the individual chairs. This type system inhibits vertical movement of the connecting table, but does not preclude horizontal movement of the chairs with respect to from the connecting table.

Other top mount connecting table systems incorporate additional protuberances to inhibit horizontal movement, and/or additional pivot arms to further inhibit vertical movement. While effective, these systems typically still allow for some amount of relative movement which is not desirable. Additionally, the user is required to position multiple pivot arms which are hidden from view beneath the table in order to first place the connecting table on an arm of a chair. Then multiple pivot arms must be manipulated to couple that chair to the connecting table. Once the first chair is connected to the connecting table, the process must be repeated for the second chair. The process is complicated by the fact that the pivot arms are positioned beneath the connecting table out of view of the operator. Thus, the process of assembling top mount connecting chair systems can be time consuming and frustrating.

In view of the foregoing, it would be advantageous to provide a connecting table which is easier to use than the above described systems when coupling a connecting table and chairs. It would be beneficial if a single moving component could simultaneously couple two individual chairs to a connecting table. It would be further beneficial if the system could be coupled in a manner which better inhibits relative movement of the components.

SUMMARY

In one embodiment, a connecting table Tete-A-Tete system includes a connecting table with two arm receptacles which are shaped and sized to removably receive at least a portion of arms from two seats. The arm portions can be introduced into the arm receptacles through respective mouths of the arm receptacles. The system includes a coupling bar with two locking portions located at opposite end portions of the coupling bar. The coupling bar is movably mounted to the connecting table and is movable between a first configuration which allows the arm portions to move through the mouths of the arm receptacles, and a second configuration which does not allow the arm portions to move through the mouths of the arm receptacles.

In one or more embodiments, the system includes at least one guide slot defined in one of the coupling bar and the connecting table and at least one guide fixedly attached to the other of the coupling bar and the connecting table and extending into the guide slot. The at least one guide slot is configured to guide movement of the coupling bar between the first and second configuration.

In one or more embodiments, one or both of the arm receptacles are defined in the connecting table so as to include receptacle end portions configured to extend around a first end of the at least a portion of the inserted arm in an arm plane along which the arm extends in a lengthwise direction.

In some embodiments the ends of the arm portions in the receptacles are differently contoured and in other embodiments ends of the arm portions in the receptacles are similarly contoured. In one or more embodiments, the receptacle end portions are configured to match the ends of the arm portions in the receptacles.

In one or more embodiments, at least one guide slot includes a central guide slot portion which is located in a movement plane and which is configured to frictionally engage a stem portion of the guide in the movement plane, and an end guide slot portion in the movement plane which is configured to not frictionally engage the stem portion of the first guide in the movement plane so as to provide a user with haptic feedback when the coupling bar is fully locked or unlocked.

In one or more embodiments, the at least one guide slot is arced and the coupling bar is pivotably attached to the connecting table through a pivot.

In one or more embodiments a second guide slot is defined in one of the coupling bar and the connecting table and is parallel to the first guide slot. In such embodiments, a second guide is fixedly attached to the other of the coupling bar and the connecting table and extends into the second guide slot.

In one or more embodiments, the guide slots are configured such that the coupling bar does not pivot as it is moved between the first and second configuration.

In accordance with one embodiment, a method of assembling a connecting table Tete-A-Tete system includes positioning a coupling bar movably attached to a connecting table in an unlocked configuration. At least a portion of an arm of a seat is then positioned in an arm receptacle portion of the connecting table by insertion of the portion of the arm through a mouth of the arm receptacle portion. Another portion of an arm of another seat is positioned in another arm receptacle portion by insertion through a mouth of the other arm receptacle portion either simultaneously with or subsequent to positioning of the first arm. The coupling bar is then moved to a locked position which simultaneously locks the two chairs to the connecting table by inhibiting movement of the portions of the arms out of the arm receptacles with locking portions of the coupling bar which are located at opposite ends of the locking bar.

In one or more embodiments, movement of the coupling bar is guided between the two configurations using a guide and guide slot arrangement. The guide slot is defined in one of the coupling bar and the connecting table and the guide is fixedly attached to the other of the coupling bar and the connecting table and extends into the guide slot.

In one or more embodiments, an end portion of at least one of the arm receptacles is defined in the connecting table such that when the portion of the arm is positioned in the arm receptacle, the first receptacle end portion extends around a first end of the at least a portion of the first arm in an arm plane.

In one or more embodiments, the shape and size of an end of the portion of at least one of the arms is matched to an end portion of the arm such that when the portion of the arm is positioned in the arm receptacle, the first receptacle end portion is in matched opposition to the portion of the arm in at least a portion of the arm plane.

In one or more embodiments, movement of the coupling bar is guided through a frictional engagement between a stem portion of the guide and a central guide slot portion of at least one sidewall of the guide slot in a movement plane. The frictional engagement is terminated as the coupling bar moves into the locked configuration.

In one or more embodiments, the coupling bar is guided in an arced path by an arced guide slot as the coupling bar pivots about a pivot attached to the connecting table.

In one or more embodiments, two guide slots, straight in some embodiments, arced in other embodiments, and two guides are used to guide movement of the guide bar.

BRIEF DESCRIPTION OF THE DRAWINGS

The accompanying drawings illustrate various embodiments of the disclosure and together with a description serve to explain the principles of the disclosure.

Corresponding reference characters indicate corresponding parts throughout the several views. Like reference characters indicate like parts throughout the several views.

DETAIL DESCRIPTION OF THE DISCLOSURE

Figure 1:
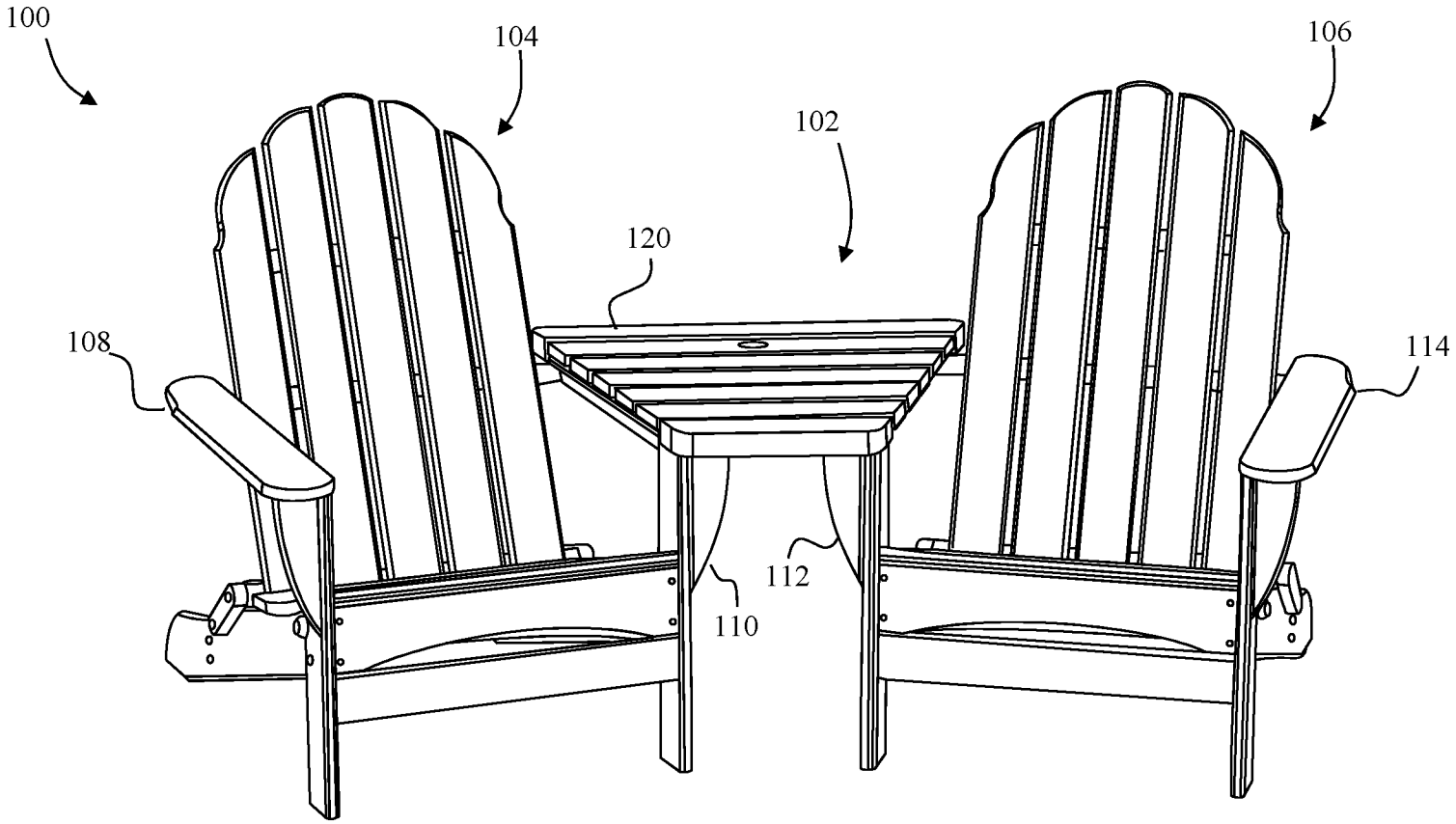
FIG. 1 depicts a front perspective view of a connecting table Tete-A-Tete system including two chairs locked together with a connecting table.

While the connecting table systems described herein are susceptible to various modifications and alternative forms, specific embodiments thereof have been shown by way of example in the drawings and will herein be described in detail. It should be understood, however, that there is no intent to limit the connecting table system to the particular forms disclosed. On the contrary, the intention is to cover all modifications, equivalents, and alternatives falling within the spirit and scope of the disclosure as defined by the appended claims.

Referring to FIG. 1, a connecting table Tete-A-Tete system 100 which addresses one or more shortcomings of the prior Tete-A-Tete systems is depicted. The connecting table Tete-A-Tete system 100 includes a connecting table 102 and two seats in the form of chairs 104 and 106. The chair 104 includes arms 108 and 110 which is some embodiments are symmetrically formed while the chair 106 includes arms 112 and 114. In some embodiments, the arms 108 and 112 are identically shaped. In other embodiments the arms 108 and 112 are differently shaped. The connecting table 102 is reversibly mechanically coupled to the chairs 104 and 106 by the arms 110 and 112.

Figure 2:
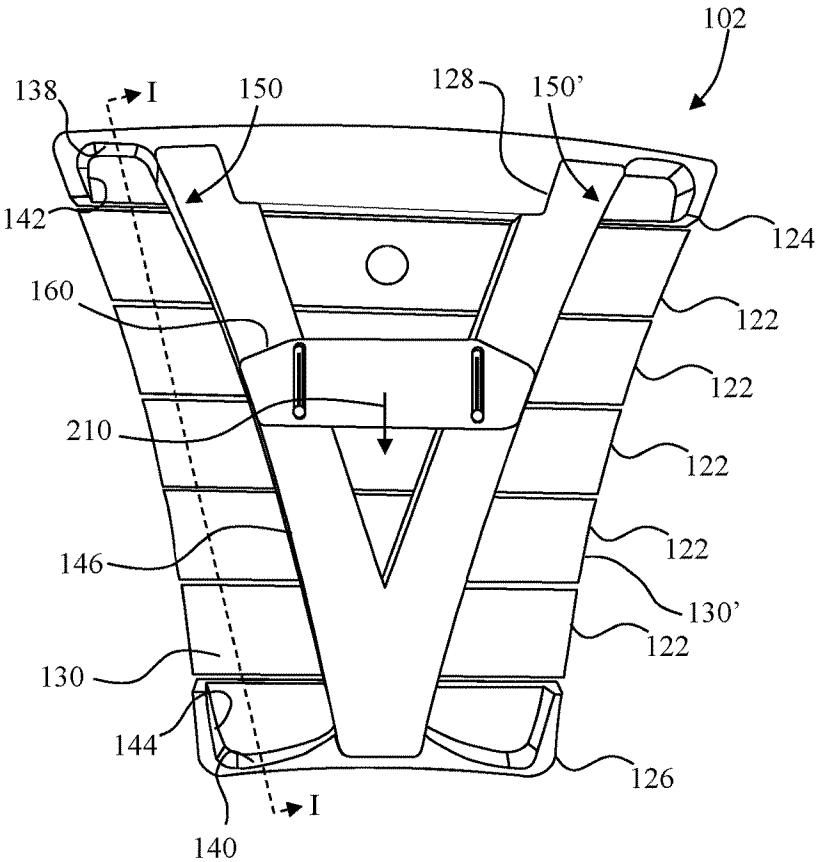
FIG. 2 depicts a bottom perspective view of one embodiment of the connecting table of FIG. 1 with a coupling bar in an unlocked position.

The connecting table 102 includes a table surface 120 which is formed in this embodiment with a number of horizontally extending planks 122 which are positioned between two end planks 124 and 126 which are shown in further detail in FIG. 2. The planks 122, 124, and 126 are joined by a connecting table base 128. In some embodiments, more or fewer planks are used. In some embodiments, the table surface 120 is integrally formed. In some integrally formed embodiments the table surface 120 and the connecting table base 128 are integrally formed.

Figure 3:
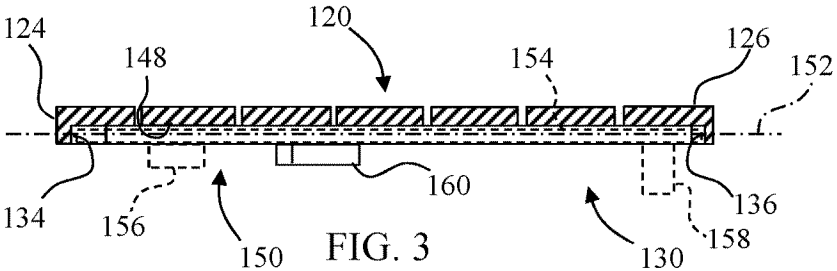
FIG. 3 depicts a cross-sectional view of the connecting table of FIG. 2 taken through the line I-I of FIG. 2.

The connecting table 102 defines, at least in part, two arm receptacles 130 and 130' which, in one embodiment, are mirror images of each other. With further reference to FIG. 3, the arm receptacle 130 includes a receptacle end portion 134 defined by the plank 124 and a receptacle end portion 136 defined by the end plank 126. The receptacle end portions 134 and 136 define opposite ends 138 and 140 of the arm receptacle 130 as well as outer wall portions 142 and 144. An inner wall 146 of the arm receptacle 130 is defined by the connecting table base 128. Each of the planks 122, 124, and 126 define a ceiling 148 of the arm receptacle 130. In some embodiments, one or more of the planks 122 additionally and/or alternatively to the end planks 124 and 126 form outer wall portions.

Accordingly, the connecting table 102 fixedly defines, in full or in part, five of the six sides of the arm receptacles 130 and 130'. The five defined sides define a mouth 150 in the arm receptacle 130 and a mouth 150' in the arm receptacle 130' which, as depicted in FIG. 2, are open. The arm receptacles 130 and 130', including the mouths 150/150', are shaped and sized such that locking portions of the arms 110 and 112 can be positioned within the arm receptacles 130/130' through the mouths 150/150'. Thus, as depicted in shadow in FIG. 3, in one embodiment an arm rest portion 154 of the arm 110 can be completely positioned within the arm receptacle 130 while support structures 156 and 158 of the arm 110 are located outside of the arm receptacle 130.

When the arm rest portion 154 is positioned within the arm receptacle 130, the receptacle end portions 134 and 136 extend completely around the opposite ends of the arm rest portion 154 in an arm plane 152 which in one embodiment is parallel to the table surface 120. The arm plane 152 in other embodiments is angled with respect to a horizontal plane by up to 15°. An "arm plane" as that term is used herein is a plane in which an arm extends lengthwise. In some embodiments, only portions of the receptacle end portions 134 and 136 are in direct opposition to the ends of the arm rest portion 154. Preferably, the shape and dimensions of the arm receptacles 130/130' are configured to match the shape and dimensions of the portions of the arms 110 and 112 which are positioned therein. In some embodiments, at least portions of the arm receptacles 130/130' are configured to match the portions of the arms 110 and 112 so as to provide a friction fit. By matching the dimensions and shapes, the potential for relative movement between the chairs 104/106 and the connecting table 102 is reduced when the chairs 104/106 are locked to the connecting table 102.

Figure 4:
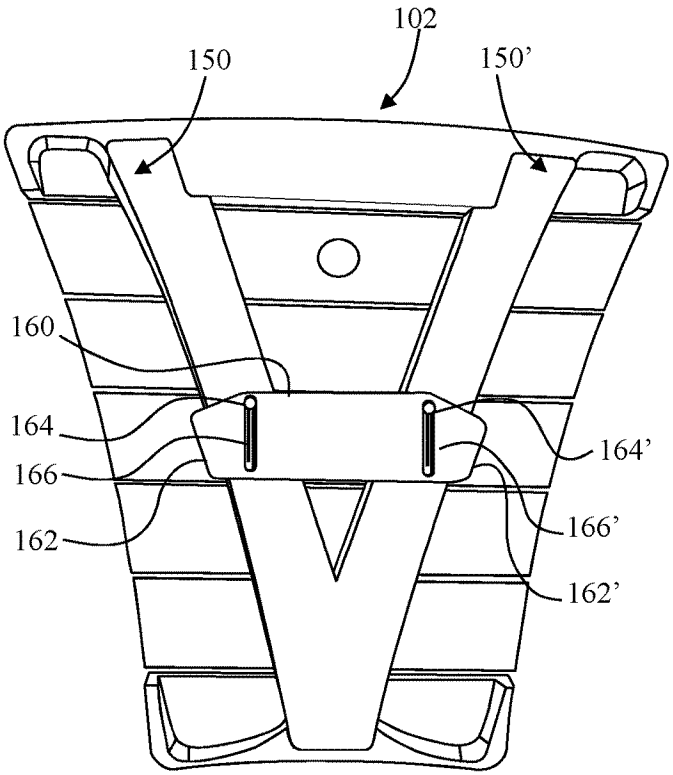
FIG. 4 depicts a bottom perspective view of the connecting table of FIG. 1 with the coupling bar in a locked position.

Locking of the chairs 104/106 to the connecting table 102 is accomplished using a coupling bar 160 which is also shown in FIG. 4. The coupling bar 160 includes two locking portions 162 and 162' which are located at opposite ends of the coupling bar 160. The coupling bar 160 is movably attached to the connecting table base 128 by two guides 164/164' which are fixedly attached to the connecting table base 128 and positioned within two guide slots 166/166', respectively. In various embodiments, more or fewer guides and guide slots are provided. In some embodiments, the positioning of the guides/guide slots is reversed such that the guides are fixedly attached to the coupling bar.

The guides 164/164' and guide slots 166/166', which are parallel to each other in the embodiment of FIG. 2, guide movement of the coupling bar 160 with respect to the connecting table base 128 such that the coupling bar 160 is movable without pivoting between the position depicted in FIG. 2 and the position depicted in FIG. 3 as will be discussed in further detail below.

Figure 5:
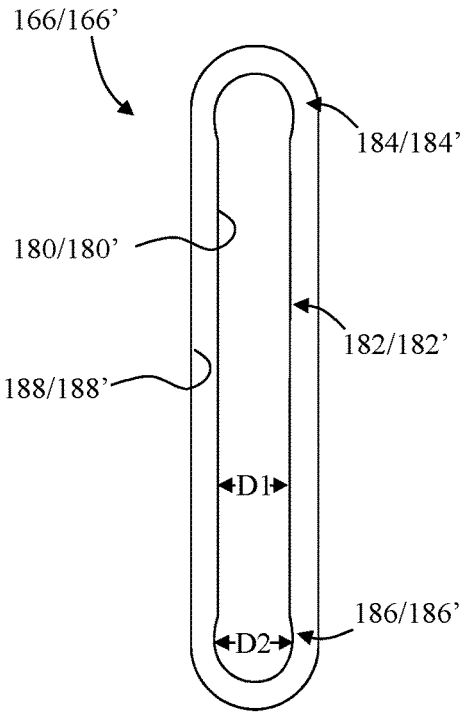
FIG. 5 depicts a bottom plan view of a guide slot of the connecting table of FIG. 1 showing enlarged end portions of the slot.
Figure 6:
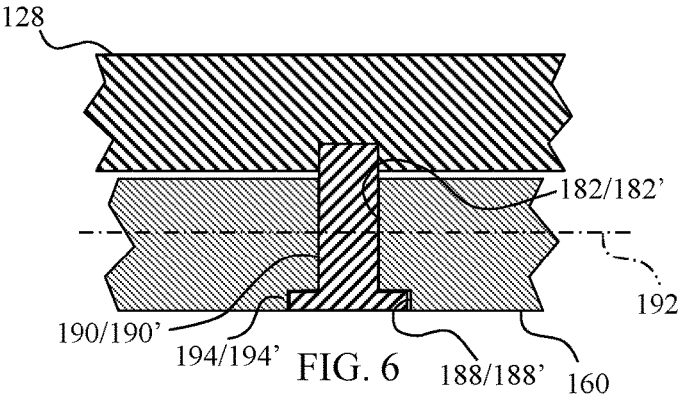
FIG. 6 depicts a partial cross sectional view of the connecting table of FIG. 1 with a guide frictionally engaged with a central portion of the guide slot of FIG. 5.
Figure 7:
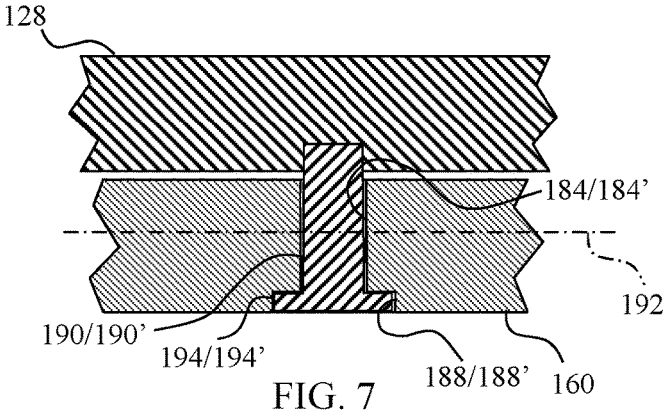
FIG. 7 depicts a partial cross sectional view of the connecting table of FIG. 1 with a guide positioned in an end portion of the guide slot of FIG. 5 whereat the guide is not frictionally engaged.

The guides 164/164' and guide slots 166/166' are shown in further detail in FIGS. 5-7. As seen in FIG. 5, the guide slots 166/166' include a respective sidewall 180/180' which defines a central guide slot portion 182/182' and two bulbous guide slot end portions 184/184' and 186/186'. A guide head slot 188/188' is located completely around the central guide slot portion 182/182' and the two bulbous guide slot end portions 184/184' and 186/186'.

A minimum diameter "D1" of the central guide slot portions 182/182' is less than a minimum diameter "D2" of the two bulbous guide slot end portions 184/184' and 186/186'. The minimum diameter D1 is selected so as to provide a frictional fit between the central guide slot portion 182/182' and a stem portion 190/190' of the guides 164/164' in a movement plane 192 as depicted in FIG. 6. A "movement plane" is a plane in which the coupling bar (or guides in some embodiments) moves. The guide head slots 188/188' are dimensioned to accept a guide head 194/194' of the guides 164/164' therein. The minimum diameter D2 is selected so as to avoid a frictional fit between the bulbous guide slot end portions 184/184' and 186/186' and the stem portions 190/190' of the guides 164/164' in the movement plane 192 as depicted in FIG. 7.

Accordingly, when the stems 190/190' transition from the central guide slot portion 182/182' to either of the bulbous guide slot end portions 184/184' and 186/186', resistance to movement is decreased and the guides 164/164' move rapidly into contact with the terminus of the guide slots 166/166' creating a haptic "snap" feedback to the user that the coupling bar 160 is in either the position shown in FIG. 2 or the position shown in FIG. 4. In some embodiments, a bulbous end portion is provided only at the end of the slot corresponding to the configuration depicted in FIG. 4. Thus, the "snap" occurs only when moving the coupling bar to a locked position. In some embodiments, the guide and guide slots are reversed, with the guides fixedly attached to the coupling bar and the guide slots defined in the connecting table base.

Figure 8:
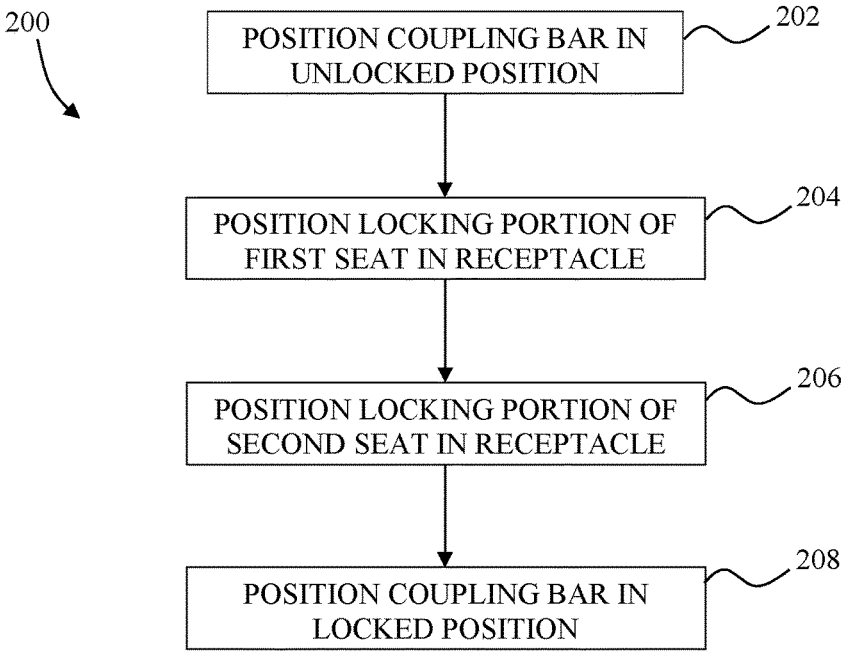
FIG. 8 depicts a method of assembling the connecting table Tete-A-Tete system of FIG. 1.

Assembly of the Tete-A-Tete system 100 is accomplished in accordance with the method 200 shown in FIG. 8 and with specific reference to the embodiment of FIG. 1. At block 202 the coupling bar 160 is positioned in an unlocked position. In the unlocked position, the locking portions 162/162' are located such that at least a portion of the arms 110 and 112 of the chairs 104 and 106, respectively, can be moved through the respective mouth 150/150'. In one embodiment this is accomplished by moving the coupling bar 160 to a location whereat no portion of the locking portions 162/162' extend directly beneath the respective mouth 150/150'. Such a configuration is depicted in FIG. 1. In some embodiments a portion of the locking portions 162/162' remains directly beneath the respective mouth 150/150'. The salient characteristic is that movement of a portion of an arm of a seat through the mouth is not prevented.

Once the coupling bar 160 is at the unlocked position, a portion of one of the arms 110/112 is positioned within the associated arm receptacle. (Block 204). Typically this is accomplished by positioning the connecting table 102 above the arm 110/112 to be positioned within the receptacle and aligning the respective arm with the respective mouth. The connecting table 102 is then lowered allowing a portion of the respective arm to pass through the respective mouth 150/150' into the arm receptacle 130/130'.

The same process is then performed with the other of the arms 110/112 such that portions of the arms of both chairs 104/106 are positioned within the respective arm receptacle 130/130'. (Block 206). At block 208 the coupling bar 160 is moved in a single movement from the position shown in FIG. 2 to the position shown in FIG. 4 by movement in the direction of the arrow 210 in FIG. 2.

As the coupling bar 160 moves in the direction of the arrow 210, the locking portions 162/162' simultaneously move directly underneath the respective mouths 150/150' to the location of FIG. 4. In the configuration of FIG. 4, the locking portions 162/162' inhibit movement of the portion of the arms 110/112 located within the arm receptacles 130/130' out of the arm receptacles 130/130' through the mouths 150/150'.

The location of the coupling bar 160 in FIG. 4 corresponds to the location of the stem 190 in FIG. 7. Accordingly, the above described movement of the coupling bar 160 is guided by the movement of the guides 164/164' within the guide slots 166/166'. Thus, as described above, when the stems 190/190' transition from the central guide slot portions 182/182' to the bulbous guide slot end portions 184/184', resistance to movement is decreased and the guides 164/164' move rapidly into contact with the terminus of the guide slot 166 creating a haptic "snap" feedback to the user that the coupling bar 160 is in the position shown in FIG. 4. The chairs 104/106 are thus coupled to the connecting table 102.

When it is desired to disassemble the connecting table Tete-A-Tete system 100, the method 200 is reversed. This allows the individual chairs 104/106 to be used separately.

In some embodiments, the process 200 is modified from that described above. For example, in some embodiments the blocks 204 and 206 are performed substantially simultaneously. Thus, both seats are first positioned, and then the connecting table is lowered the arms of the two seats. In other embodiments, the first arm is positioned within a receptacle and locked into position. The second seat is them moved into position and the coupling bar is moved to the unlocked position to allow a portion of an arm of the second seat to move into the respective arm receptacle. These modifications and others are within the scope of the disclosure.

Figure 9:
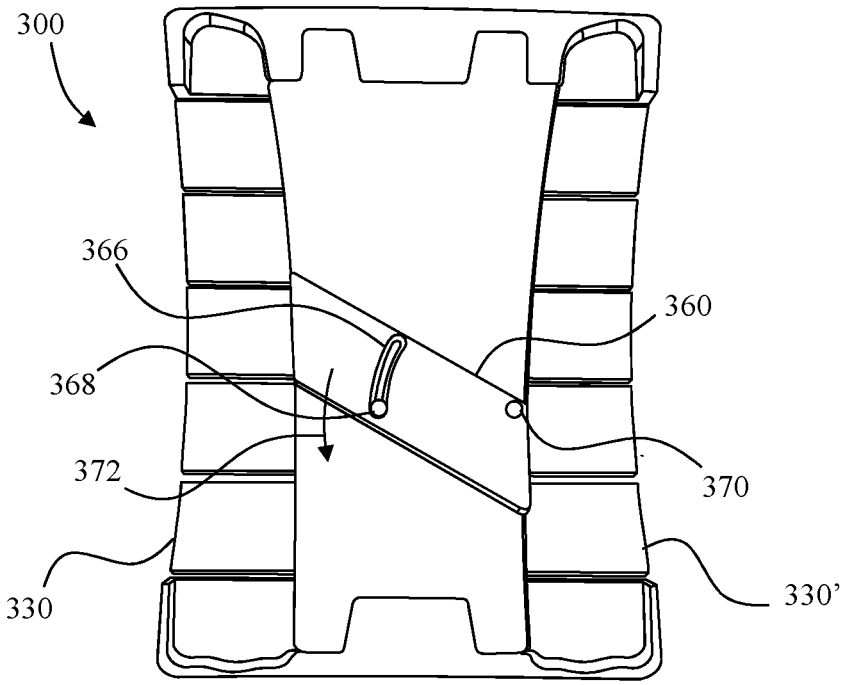
FIG. 9 depicts a bottom perspective view of one embodiment of the connecting table of FIG. 1 with a coupling bar in an unlocked position.
Figure 10:
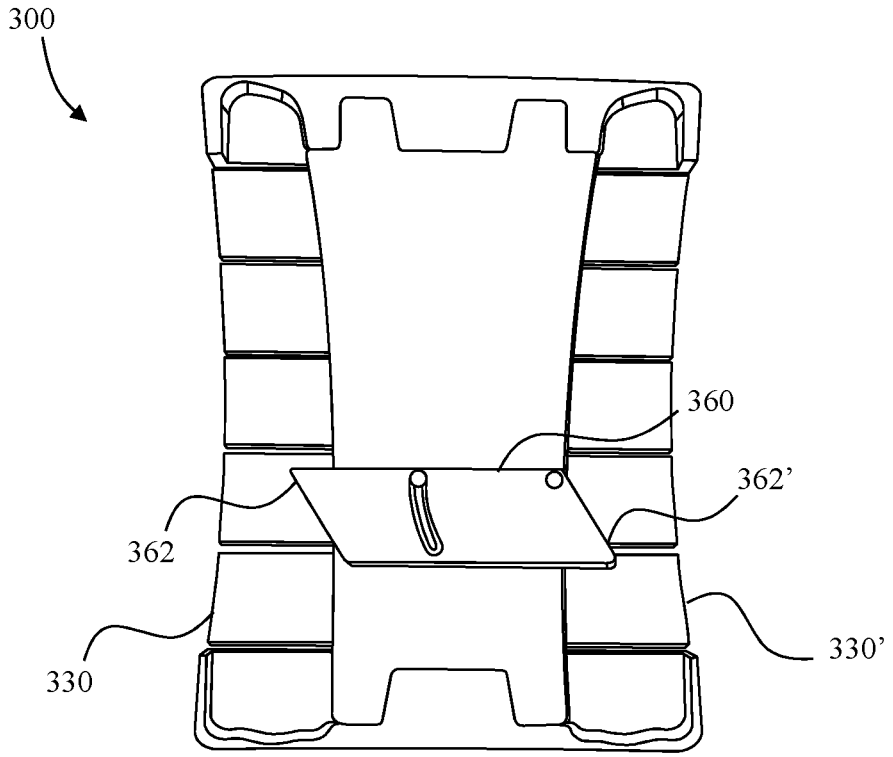
FIG. 10 depicts a bottom perspective view of the connecting table of FIG. 9 with the coupling bar in a locked position after pivoting about a pivot pin attached to the connecting table.

Movement of the coupling bar 160 in the embodiment of FIG. 1 is accomplished by moving the coupling bar 160 in a straight line from the configuration of FIG. 2 to the configuration of FIG. 4 in the direction of the arrow 210. In some embodiments an arcuate movement is effected. By way of example, FIGS. 9 and 10 depict a connecting table Tete-A-Tete system 300 that is substantially the same as the connecting table Tete-A-Tete system 100 and is used in some embodiments with the chairs 104/106 or other seats with arms. Rather than having straight guide slots 168/168' and two guides 166/166', however, the connecting table Tete-A-Tete system 300 includes a single guide 366 and a single arcuate guide slot 368 which in some embodiments is configured to provide a haptic function in the manner described above with respect to the guide slots 168/168' and guides 166/166'. The connecting table Tete-A-Tete system 300 further includes a pivot 370.

Locking of the connecting table 302 to two seats (not shown in FIGS. 9 and 10) is accomplished in one embodiment using the process 200. The difference between the embodiment of FIG. 9 and the embodiment of FIG. 1 is that movement of the coupling bar 360 is accomplished by pivoting the coupling bar 360 about the pivot 370 in the direction of the arrow 372 from the configuration of FIG. 9 to the configuration of FIG. 10. The pivoting movement of the coupling bar 360 moves the locking portions 362/362' directly underneath the arm receptacles 330/330' simultaneously.

The connecting table Tete-A-Tete system 300 further differs from the connecting table Tete-A-Tete system 100 in that the angle formed by the arm receptacles 330/330' is smaller than the angle formed by the arm receptacles 130/130'. This provides for a less intimate seating arrangement.

The connecting table embodiments described above include two arm receptacles which are completely separated by the connecting table base 128. In some embodiments, however, there is no separation between the two arm receptacles at some portion of the adjacent arm receptacles. In some such embodiments some portion of the two arms in the two receptacles are in contact while in other such embodiments the two arms are spaced apart.

While the seats in the embodiment of FIG. 1 are chairs, the disclosed connecting tables in other embodiments are used with another form of a seat including at least one arm including, but not limited to, a sofa, a bench, a couch, etc.

While the disclosure has been illustrated and described in detail in the drawings and foregoing description, the same should be considered as illustrative and not restrictive in character. It is understood that only the preferred embodiments have been presented and that all changes, modifications and further applications that come within the spirit of the disclosure are desired to be protected.

The invention claimed is:

1. A connecting table Tete-A-Tete system, comprising:

a connecting table including a first arm receptacle portion configured to removably receive at least a portion of a first arm of a first chair seat, and including a second arm receptacle portion configured to removably receive at least a portion of a second arm of a second seat;

a first mouth of the first arm receptacle portion configured to allow the at least a portion of the first arm to pass therethrough;

a second mouth of the second arm receptacle portion configured to allow the at least a portion of the second arm to pass therethrough; and a coupling bar movably attached to the connecting table and selectably positionable in a first configuration and in a second configuration, the coupling bar including a first locking portion located at a first coupling end portion of the coupling bar and a second locking portion at a second coupling end portion of the coupling bar, the second coupling end portion opposite the first coupling end portion, wherein in the first configuration the first locking portion does not prevent movement of the at least a portion of the first arm through the first mouth, in the first configuration the second locking portion does not prevent movement of the at least a portion of the second arm through the second mouth, in the second configuration the first locking portion inhibits movement of the at least a portion of the first arm through the first mouth, and in the second configuration the second locking portion inhibits movement of the at least a portion of the second arm through the second mouth.

2. The system of claim 1 further comprising:

a first guide slot defined in one of the coupling bar and the connecting table; and a first guide fixedly attached to the other of the coupling bar and the connecting table and extending into the first guide slot, the first guide slot configured to guide movement of the coupling bar between the first and second configuration.

3. The system of claim 2, further comprising:

a first receptacle end portion of the first arm receptacle defined in the connecting table, the first receptacle end portion configured to extend around a first end of the at least a portion of the first arm in an arm plane.

4. The system of claim 3, further comprising:

a second receptacle end portion of the first arm receptacle defined in the connecting table, the second receptacle end portion configured to extend around a second end of the at least a portion of the first arm in the arm plane.

5. The system of claim 4, wherein:

the first receptacle end portion is configured to match the first end of the at least a portion of the first arm in the arm plane; and the second receptacle end portion is configured to match the second end of the at least a portion of the first arm in the arm plane.

6. The system of claim 5, the first guide slot comprising at least one sidewall, the at least one sidewall including:

a central guide slot portion located in a movement plane and configured to frictionally engage a stem portion of the first guide in the movement plane when the stem portion is positioned in the central guide slot portion in the movement plane; and an end guide slot portion located in the movement plane and configured to not frictionally engage the stem portion of the first guide in the movement plane when the stem portion is positioned in the end guide slot portion in the movement plane.

7. The system of claim 5, wherein:

the first guide slot is arced; and the coupling bar is pivotably attached to the connecting table through a pivot.

8. The system of claim 5, further comprising:

a second guide slot defined in one of the coupling bar and the connecting table, the second guide slot parallel to the first guide slot; and a second guide fixedly attached to the other of the coupling bar and the connecting table and extending into the second guide slot.

9. The system of claim 8, wherein the first and second guide slots are configured such that the coupling bar does not pivot as it is moved between the first and second configuration.

10. A method of assembling a connecting table Tete-A-Tete system, comprising:

positioning a coupling bar movably attached to a connecting table in a first configuration;

positioning at least a portion of a first arm of a first seat in a first arm receptacle portion of the connecting table with the coupling bar in the first configuration by moving the at least a portion of the first arm in a first direction through a first mouth of the first arm receptacle portion;

positioning at least a portion of a second arm of a second seat in a second arm receptacle portion of the connecting table with the coupling bar in the first configuration by moving the at least a portion of the second arm in the first direction through a second mouth of the first arm receptacle portion; and simultaneously inhibiting movement of the at least a portion of the first arm through the first mouth and movement of the at least a portion of the second arm through the second mouth by moving the coupling bar from the first configuration to a second configuration such that a first locking portion located at a first coupling end portion of the coupling bar inhibits movement of the at least a portion of the first arm through the first mouth, and such that a second locking portion located at a second coupling end portion of the coupling bar inhibits movement of the at least a portion of the second arm through the second mouth, the second coupling end portion opposite the first coupling end portion.

11. The method of claim 10 wherein moving the coupling bar from the first configuration to a second configuration comprises:

guiding movement of the coupling bar between the first and second configuration by guiding a first guide with a first guide slot, wherein the first guide slot is defined in one of the coupling bar and the connecting table and the first guide is fixedly attached to the other of the coupling bar and the connecting table and extends into the first guide slot.

12. The method of claim 11, wherein positioning the at least a portion of the first arm of the first seat in the first arm receptacle portion of the connecting table comprises:

positioning the at least a portion of the first arm of the first seat in a first receptacle end portion of the first arm receptacle defined in the connecting table such that the first receptacle end portion extends around a first end of the at least a portion of the first arm in an arm plane.

13. The method of claim 12, wherein positioning the at least a portion of the second arm of the second seat in the second arm receptacle portion of the connecting table comprises:

positioning the at least a portion of the second arm of the second seat in a second receptacle end portion of the second arm receptacle defined in the connecting table such that the second receptacle end portion extends around a second end of the at least a portion of the second arm in the arm plane.

14. The method of claim 13, wherein:

positioning the at least a portion of the first arm of the first seat in the first receptacle end portion of the first arm receptacle includes positioning the at least a portion of the first arm of the first seat in a first receptacle end portion configured to match the first end of the at least a portion of the first arm in the arm plane; and positioning the at least a portion of the second arm of the second seat in the second receptacle end portion of the second arm receptacle includes positioning the at least a portion of the second arm of the second seat in a second receptacle end portion configured to match the second end of the at least a portion of the second arm in the arm plane.

15. The method of claim 14, wherein guiding movement of the coupling bar between the first and second configuration comprises:

frictionally engaging a stem portion of the first guide in a movement plane, as the coupling bar is moved from the first configuration to the second configuration, with a central guide slot portion of at least one sidewall; and terminating the frictional engagement of the stem portion of the first guide in the movement plane as the coupling bar moves into the second configuration.

16. The method of claim 14, wherein guiding movement of the coupling bar between the first and second configuration comprises:

guiding the first guide with an arced guide slot, and wherein moving the coupling bar from the first configuration to the second configuration comprises:

pivoting the coupling bar using a pivot attached to the connecting table.

17. The method of claim 14, wherein guiding movement of the coupling bar between the first and second configuration further comprises:

guiding a second guide with a second guide slot, wherein the second guide slot is defined in one of the coupling bar and the connecting table and the second guide is fixedly attached to the other of the coupling bar and the connecting table and extends into the second guide slot.

18. The method of claim 17, wherein the coupling bar does not pivot as it is moved between the first and second configuration.

* * * * *